US008617000B2

(12) United States Patent
Ferguson et al.

(10) Patent No.: US 8,617,000 B2
(45) Date of Patent: Dec. 31, 2013

(54) METAL WOOD GOLF CLUB HEAD HAVING EXTERNALLY PROTRUDING WEIGHTS

(75) Inventors: Gentry Ferguson, Encinitas, CA (US); Keisuke Yamane, Laguna Niguel, CA (US); Ronald K. Hettinger, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 170 days.

(21) Appl. No.: 13/173,279

(22) Filed: Jun. 30, 2011

(65) Prior Publication Data

US 2013/0005504 A1 Jan. 3, 2013

(51) Int. Cl.
*A63B 5/06* (2006.01)
*A63B 5/04* (2006.01)

(52) U.S. Cl.
USPC ..... 473/335; 473/334; 473/349; 473/350

(58) Field of Classification Search
USPC ..... 473/334–339, 349, 350
See application file for complete search history.

(56) References Cited

U.S. PATENT DOCUMENTS

| | | | | |
|---|---|---|---|---|
| 5,058,895 | A | 10/1991 | Igarashi | |
| 5,658,206 | A | 8/1997 | Antonious | |
| 5,766,095 | A | 6/1998 | Antonious | |
| 6,332,848 | B1 | 12/2001 | Long et al. | |
| 6,458,044 | B1 | 10/2002 | Vincent et al. | |
| 6,680,818 | B1 | 1/2004 | Morita et al. | |
| 6,773,360 | B2 | 8/2004 | Willett et al. | |
| 7,166,038 | B2 | 1/2007 | Williams et al. | |
| 7,166,040 | B2 | 1/2007 | Hoffman et al. | |
| 7,377,860 | B2 | 5/2008 | Breier et al. | |
| 7,413,520 | B1 * | 8/2008 | Hocknell et al. | 473/345 |
| 8,371,957 | B2 * | 2/2013 | Schweigert et al. | 473/324 |
| 2009/0105010 | A1 * | 4/2009 | De La Cruz et al. | 473/345 |
| 2011/0250986 | A1 | 10/2011 | Schweigert et al. | |

* cited by examiner

*Primary Examiner* — Benjamin Layno
(74) *Attorney, Agent, or Firm* — Randy K. Chang

(57) ABSTRACT

A metal wood golf club with externally protruding weights that improves the performance of a golf club head is disclosed herein. More specifically, the present invention discloses a metal wood type golf club head that is capable of pushing the boundaries of performance all while maintaining the size and shape of a classic pear shaped golf club.

20 Claims, 4 Drawing Sheets

METAL WOOD GOLF CLUB HEAD HAVING EXTERNALLY PROTRUDING WEIGHTS

FIELD OF THE INVENTION

The present invention relates generally to a metal wood golf club with externally protruding weights that improves the performance of the golf club head. More specifically, the present invention relates to a metal wood type golf club that is capable of pushing the boundaries of golf club performance by placing high density weights outside the natural contour of the club head. The metal wood type golf club head, by having such extreme placement of the high density weights outside the natural contour of the golf club head, allows the golf club head to achieve extremely high Moment of Inertia (MOI) numbers along the heel and toe direction without sacrificing the traditional size and shape associated with a classic pear looking golf club head.

BACKGROUND OF THE INVENTION

With the advent of the modern day metal wood golf clubs, new design challenges that never existed during the persimmon wood golf club days are facing modern golf club designers. Because internal cavity of a metal wood golf club is generally hollow it allowed the metalwood type golf clubs to be made larger without increasing the overall weight of the golf club head. To further increase the size of the golf club head, golf club designers began experimenting with lighter weight metallic materials that allows the modern day metal wood golf clubs to reach volume ranges in excess of 400 cubic centimeters.

The increase in the size of the golf club head in the modern day metalwood type golf club head is mostly intentional by design, as a larger sized club heads create more forgiveness for off center hits with a golf ball. This increase in forgiveness may generally be referred to as an increase in the MOI of the golf club head in the golfing industry, as an increase in the MOI of the golf club head relates to the resistance of the club head against undesirable twisting when impacting a golf ball off center. Golf club designers, in order to further push the boundaries of increasing the MOI of a golf club head to make it even more forgiving, have experimented with extreme shapes and dimensions in addition to the increase in the size of the golf club head; as the maximum size allowable for a golf club head has been limited by the USGA. U.S. Pat. No. 7,166,038 to Williams et al. provides one of the earlier attempts to push the boundaries of MOI by manipulating the shape of the golf club head away from the traditional classic pear shape. More specifically, U.S. Pat. No. 7,166,038 discloses a substantially square of rectangular body golf club head having a volume ranging from 420 cc to 470 cc, having a moment of inertia about the Izz axis through the center of gravity greater than 4000 grams-centimeter squared, and a moment of inertia about the Ixx axis through the center of gravity greater than 300 grams-centimeters squared.

However, despite the performance gains of such unconventional shaped golf clubs, the introduction of such unconventional shapes have been met with mixed reception. While certain golfers cherish the added forgiveness provided by these new unconventionally shaped drivers, a significant portion of the golfing demographic are less than excited about the size, shape, and sound of these unconventionally shaped drivers.

U.S. Pat. No. 6,773,360 to Willett et al. provides an alternative approach to improve the MOI of a golf club head without having to alter the external appearance of the golf club head. More specifically, U.S. Pat. No. 6,773,360 teaches a golf club having adjustable weight, allowing the golfer to fine tune the club for his or her swing; wherein the body defines an interior cavity and a recess with a threaded opening within the recess. A weight assembling having a fastener and a mass element is configured to be press-fit into the recess such that the first end is adjacent the bottom of the recess.

Although U.S. Pat. No. 6,773,360 provides a very viable solution to increase the MOI of a golf club head without tampering with the visual aesthetics of a golf club head, it's utilization of internal recess and threads means that the weights are generally placed inside the natural contours of the golf club head; limiting the effectiveness of the weight in increasing the MOI. It is generally know in the art that the further a weight can be placed away from the center of gravity of a golf club head, the more effective it is in preventing the golf club head from twisting, as more force is required to move a weighs that are placed further away from the center.

Hence, it can be seen from above there is a need in the field for a golf club that can truly take advantage of the performance benefits that come with the advent of the metalwood type golf club without sacrificing the visual aesthetic appeal of the golf club. More specifically, there is a need in the field for a metalwood type golf club that is capable of maintaining the traditional classic pear shaped profile look all while maximizing the MOI achievable.

BRIEF SUMMARY OF THE INVENTION

In one aspect of the present invention is a metal wood golf club head comprising a body portion forming a natural contour of the golf club head, a sole portion near a bottom of the golf club head, and a weight placed outside the natural contour of the golf club head. The golf club head will have a MOIy to Front to Back Distance Ratio of greater than about 838 g-cm, the MOIy to Front to Back Distance Ratio is defined as the MOIy of the club head divided by a front to back distance of the golf club head.

In another aspect of the present invention is a metal wood golf club head comprising a body portion forming a natural contour of the golf club head, a sole portion near a bottom of the golf club head, and a weight placed outside the natural contour of the golf club head. The placement of the weight is constrained by an inner concentric circle and an outer concentric circle, viewed from a two dimensional projection taken from a heel view of the golf club head. The inner concentric circle has a radius of 89.4 mm with a center located 33.1 mm backward along the z axis and 19.3 mm upward along the y-axis from a center of gravity of the golf club head. The outer concentric circle has a radius of 94.8 mm with a center located 33.1 mm backward along the z-axis and 19.3 mm upward along the y-axis from a center of gravity of the golf club head.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
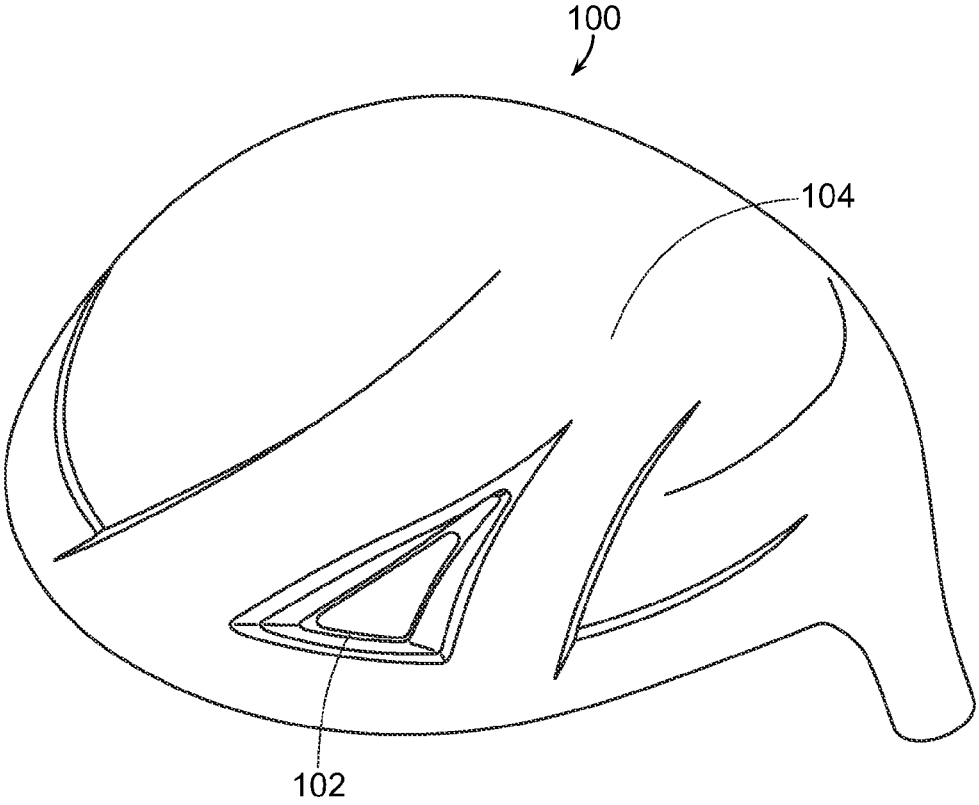
FIG. 1 of the accompanying drawings provides a perspective view of a golf club head in accordance with an exemplary embodiment of the present invention.

FIG. 1 of the accompanying drawings shows a perspective sole view of a golf club head 100 in accordance with an exemplary embodiment of the present invention. More specifically, FIG. 1 shows golf club head 100 with a weight 102 placed at an external portion of a sole 104 of the golf club head. The weight 102 attached to the golf club head 100 may generally be placed outside a natural contour of the profile of the golf club head 100, creating a golf club head 100 having externally protruding weights 102. Golf club head 100, as shown in the current exemplary embodiment of the present invention, may generally be made out of a titanium material having a first density of about 4.5 g/cc for it's high strength and low mass characteristics; however, numerous other types of metallic materials with high strength-to-weight ratios could be used without departing from the scope and content of the present invention so long as they have a first density of between about 4.0 g/cc and about 5.0 g/cc. Weight 102, on the other hand, may generally be made out of a material having a higher density than the titanium material used to construct the golf club head 100 in order to provide a more discernable effect in the Center of Gravity (CG) and MOI of the golf club head 100. More specifically, weight 102 may generally be constructed out of a tungsten type material having a second density of about 17.0 g/cc; however numerous other materials such as molybdenum, zirconium, tantalum, brass, copper, golf, or even platinum could all be used without departing from the scope and content of the present invention so long as it has a density that is substantially greater than the density of the club head 100 itself. Alternatively speaking, the material used for the weight 102 may generally have a second density of greater than about 9.0 g/cc, more preferably greater than about 9.5 g/cc, and most preferably greater than about 10.0 g/cc all without departing from the scope and content of the present invention.

The golf club head 100 in accordance with an exemplary embodiment of the present invention, in order to maintain its traditional compact pear shape, may generally have a mass of less than about 200 grams, more preferably less than about 195 grams, and most preferably less than about 190 grams. Having such a lightweight golf club head 100 makes increasing the performance of the golf club head 100 even more difficult, as there is not much discretionary weight for a golf club designer to manipulate.

Figure 2:
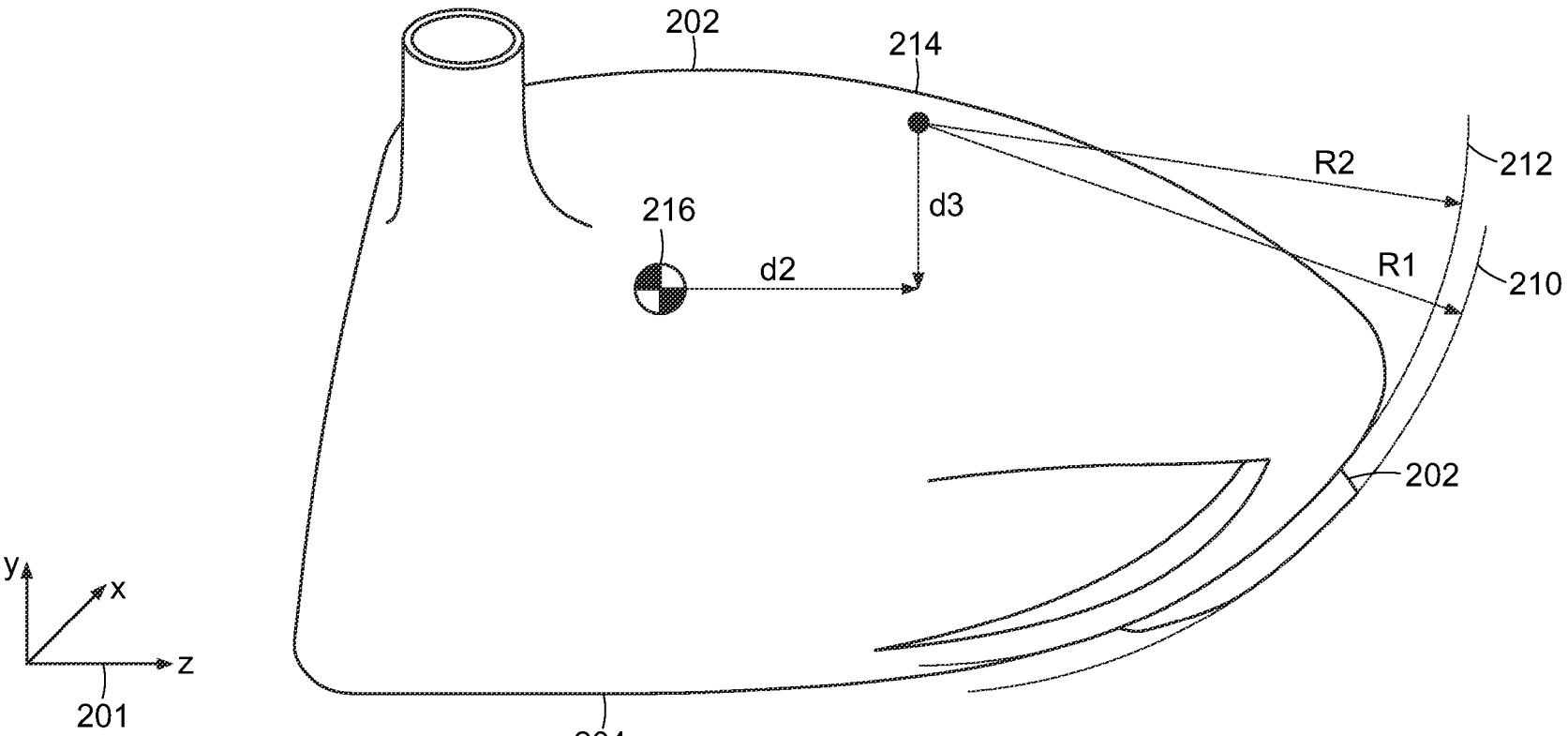
FIG. 2 of the accompanying drawings provides a heel view of a golf club head in accordance with an exemplary embodiment of the present invention.

FIG. 2 of the accompanying drawings shows a heel side view of a golf club head 200 in accordance with the present invention. The heel view of the golf club head 200 allows the placement of the weight 202 outside the natural contours of the golf club head 200 to be shown more clearly. More specifically, it can be seen from FIG. 2, the weight 202 protrudes out from the rear portion of the sole 204 of the golf club head 200 to place the higher density weight at a location that is as far away from the CG 216 as possible. Basic understanding of the concept of the MOI of a golf club indicates that the MOI of a golf club head 200 it the ability of the golf club head 200 to resist twisting at impact, hence the further a high density weight 202 is placed away from the CG 216, the harder it will be for that weight 202 to be moved.

Figure 4:
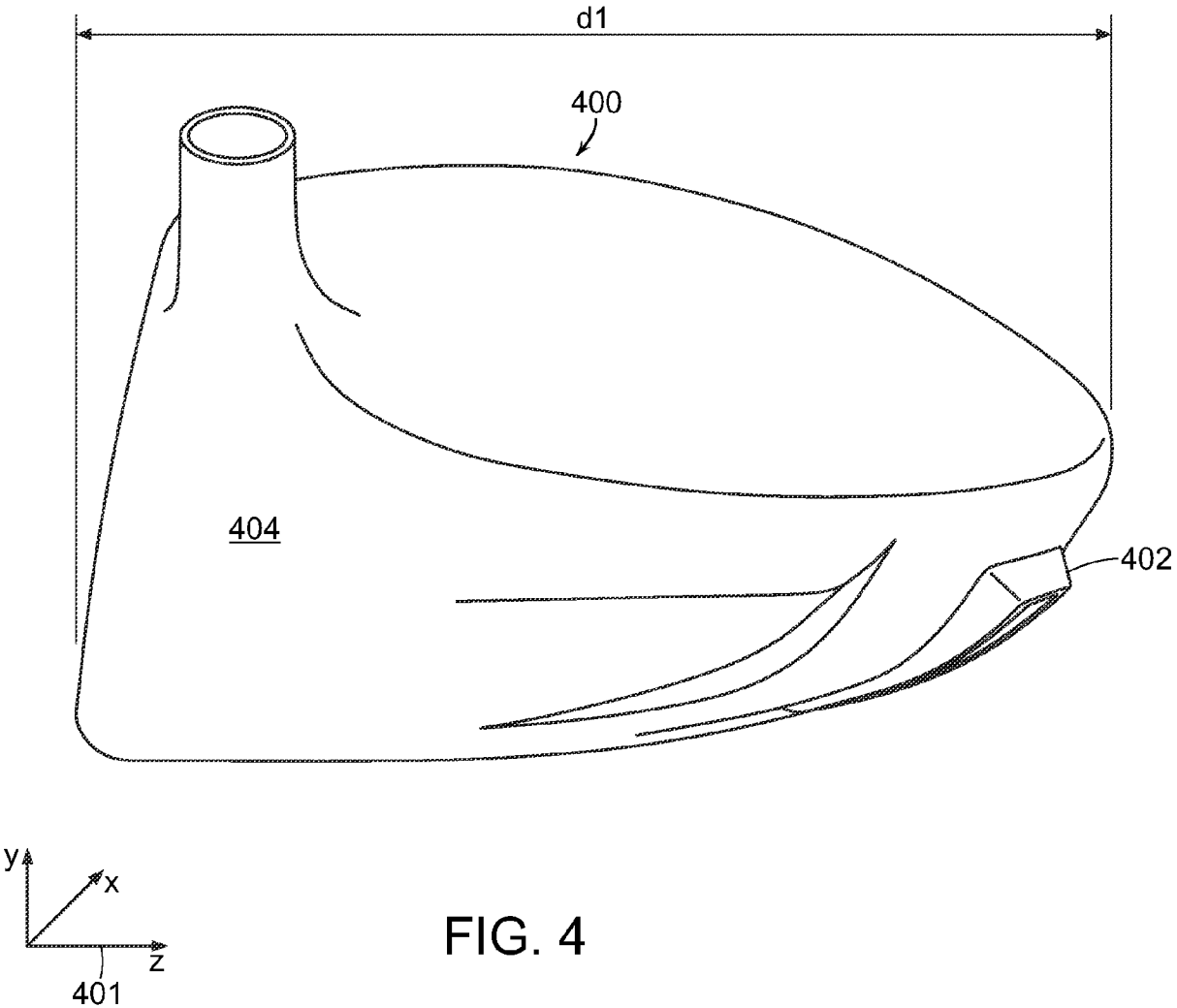
FIG. 4 of the accompanying drawings provides a heel view of a golf club head in accordance with an exemplary embodiment of the present invention.

In order to more precisely describe the placement of the weight 202 outside the natural contours of the golf club head 200 itself, FIG. 4 also shows two radial boundaries drawn near the rear of the golf club head 200, wherein the placement of the high density weight 202 may generally be constrained by two concentric circles 210 and 212; both having their center point 214 located at a distance that is offset from the CG 216. More specifically, looking at the two dimensional projection shown in FIG. 2, it can be said that the center 214 is located at a location that is at a distance d2 of 33.1 mm backwards in the positive z-direction from the CG 216, and at a distance d3 of 19.3 mm upwards in the positive y-direction from the CG 216. Using center point 214 as a point of reference, the outer concentric circle 210 may have a radius R1 of 94.8 mm; while the inner concentric circle 212 may have a radius R2 of 89.4 mm. In essence, the inner concentric circle 212 closely resembles the natural contours of the golf club head 200 near the back of the sole 204; and having the weight 202 placed between the inner concentric circle 212 and the outer concentric circle 210 provides a more methodological way of characterizing the placement of the weight 202 outside the natural contours of the golf club head 200.

Figure 3:
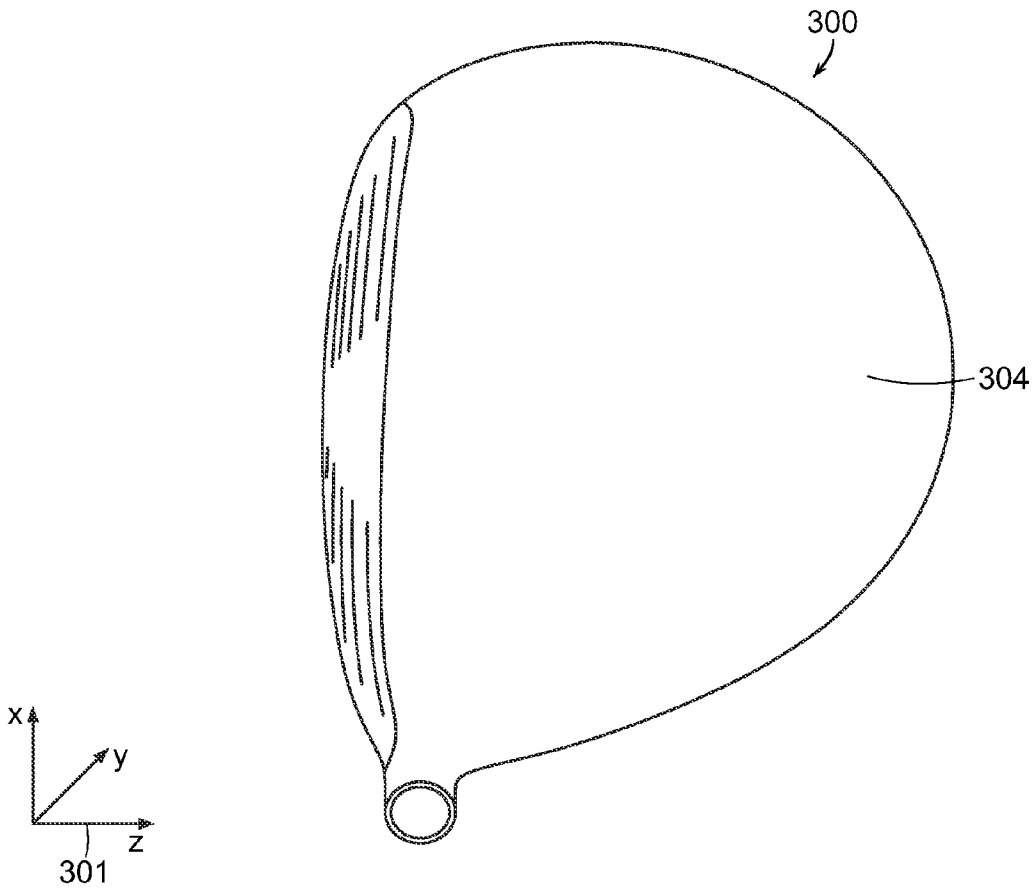
FIG. 3 of the accompanying drawings provides a top view of a golf club head in accordance with an exemplary embodiment of the present invention.

FIG. 3 of the accompanying drawings showing a top view of a golf club head 300 provides another interesting design goal of a golf club head 300 in accordance with an exemplary embodiment of the present invention. First off, FIG. 3 of the accompanying drawings provides a coordinate axis 301 indicating that the top view being in an x-z plane. More specifically, FIG. 3 of the accompanying drawing shows the x-axis being in a heel toe direction relative to the club head 300, the y-axis going in a crown to sole direction relative to the club head 300, and the z-axis going in a front to back direction relative to the club head 300. More importantly, FIG. 3 of the accompanying drawings illustrates that despite the fact that the weight 202 (shown in FIG. 2) is placed outside the natural contours of the golf club head 300, it is completely invisible to a golfer from a top view from an address position. Concealing the weight 202 (shown in FIG. 2) from the top view is important to the visual appeal of the golf club head 300, which in some circumstances, can be just as important as the performance gains of the golf club head 300 itself. Like the previous discussions have already indicated, a large majority of golfers are very particular about the way their golf club looks aesthetically, and extreme deviations from the conventional natural size and shape such as bulging weights can often adversely affect the confidence of a golfer to swing the golf club.

Hence, in order to preserve the natural contours generally associated with a golf club head 300, all while by having a high density weight pad protrude out from that same natural contour to increasing the MOI numbers of a golf club head 300; the present invention maintains such a protrusion on the sole portion of the golf club head 300. By placing the high density weight 202 (shown in FIG. 2) outside the natural contours of the golf club head 300, all while maintaining a aesthetically pleasing appeal by concealing the weight 202 (shown in FIG. 2) from view from address, helps the present invention strike a good balance between increasing performance and preserving aesthetic appeal.

Keeping with the trend of maintaining aesthetic appeal of a golf club head 300, it should be noted that the aesthetic appeal of a golf club extends beyond the mere concealing of the protrusion of the weight 202 (shown in FIG. 2) from view. For many golfers, especially the traditionalists, the aesthetic appeals of a golf club head 300 may generally relate to its size and shape. Although it is difficult to capture the exact size and shape of a golf club that will be preferred for every single golfer, it is generally known that a majority of the traditional golfers prefer a pear shaped club head that is compact in size. One of the major factors that go into determining the compactness of a golf club head 300 is the front to back distance of the golf club head 300.

FIG. 4 of the accompanying drawings provides a heel view of a golf club head 400 allowing the front to back distance d1 to be shown more clearly. Front to back distance d1, as shown in this current exemplary embodiment of the present invention, may generally be less than about 11.20 cm, more preferably less than about 11.10 cm, and most preferably less than about 11.00 cm to indicate that the golf club head 400 may generally be compact, thus having a shorter front to back distance d1. However, the front to back distance d1, when view alone in vacuum, does not provide much more information other than the compactness of the golf club head 400. The current inventive embodiment of the present invention gets its distinction from the majority of the competitors by having improved performance, all while maintaining a aesthetically pleasing golf club head 400 that also has a compact size, as indicated by a small front to back distance d1.

The improved performance of the current inventive golf club head 400, as already foreshadowed earlier, may generally relate to the increase in the moment of inertia of the golf club head 400 all while maintaining the aesthetic appeal of a traditional golf club head. Before a discussion can be had about the MOI of the golf club head, it is worthwhile to establish the relative axis 401 of reference from which the MOI will be referred to. It can be seen from the axis 401 shown in FIG. 4, the x-axis runs in a heel to toe direction, with the positive value pointed towards the toe; the y-axis runs in a crown to sole direction, with the positive value pointed towards the crown; and the z-axis runs in a front to back direction, with the positive value pointed towards the back of the golf club head. The MOI about the x-axis, also known as MOIx, refers to the ability of the golf club to resist rotation about the x-axis; the MOI about the y-axis, also known as MOIy, refers to the ability of the golf club to resist rotation about the y-axis; and the MOI about the z-axis, also known as MOIz, refers to the ability of the golf ball to resist rotation about the z-axis.

With the coordinate system established, the MOI that is affected the most by the placement of the high density weights 402 outside the natural contours of the golf club head is the MOIy. The MOIy of the golf club head in accordance with an exemplary embodiment of the present invention may generally be greater than about 4300 g-cm$^2$, more preferably greater than about 4400 g-cm$^2$, and most preferably greater than about 4500 g-cm$^2$. What is interesting about the MOIy numbers in the current exemplary embodiment is not the absolute MOIy numbers, but the ability to reach such a high MOIy number given the compact size of the golf club head 400, as indicated by the front to back distance d1. Hence, in order to properly capture the ability of the current inventive golf club head 400 to increase MOIy all while maintaining a compact traditional size and shape, a MOIy to Front to Back Distance Ratio is created below in Equation (1):

$$MOIy \text{ to Front to Back Distance Ratio} = \frac{MOIy(\text{g-cm}^2)}{\text{Front to Back Distance (cm)}} \quad \text{Eq. (1)}$$

A golf club head 400 in accordance with an exemplary embodiment of the present invention may generally have a MOIy to Front to Back Distance Ratio of greater than about 383 g-cm, more preferably greater than about 396 g-cm, and most preferably greater than about 409 g-cm.

It is worthwhile to re-emphasize here that the present invention doesn't merely create a golf club head 400 with an improved MOIy, but is capable of achieving such a MOIy number all while maintaining a traditional club head size and shape. However, the size and shape of the golf club head 400 that is preferred by a golfer is not merely related to the volume of the golf club head 400 itself; but rather in situations like this, can be more accurately captured by the Front to Back Distance d1. The ratio above capturing the relationship between the MOIy of the golf club head 400 and the Front to Back Distance d1 symbolizes the ability of the current inventive golf club head 400 to improve the performance all while maintaining a traditional pear shape golf club head 400 in terms of both the size and shape.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A metal wood golf club head comprising:

a body portion forming a natural contour of said golf club head;

a sole portion near a bottom of said golf club head; and a weight placed near a sole portion of said golf club head;

wherein said weight is invisible from a top view from an address position; and wherein said golf club head has a MOIy to Front to Back Distance Ratio of greater than about 838 g-cm;

said MOIy to Front to Back Distance Ratio defined is a MOIy of said golf club head divided by a front to back distance of said golf club head.

2. The metal wood golf club head of claim 1, wherein said MOIy to Front to Back Distance Ratio is greater than about 396 g-cm.

3. The metal wood golf club head of claim 2, where said MOIy to Front to Back Distance Ratio is greater than about 409 g-cm.

4. The metal wood golf club head of claim 1, wherein said golf club head has a mass of less than about 200 grams.

5. The metal wood golf club head of claim 4, wherein said mass of said golf club head is less than about 195 grams.

6. The metal wood golf club head of claim 5, wherein said mass of said golf club head is less than about 190 grams.

7. The metal wood golf club head of claim 1, wherein a first material used to form said body portion has a first density of between about 4.0 g/cc and about 5.0 g/cc.

8. The metal wood golf club head of claim 7, wherein said first density is about 4.5 g/cc.

9. The metal wood golf club head of claim 8, wherein said first material is titanium.

10. The metal wood golf club head of claim 7, wherein a second material used to form said weight has a second density that is greater than said first density.

11. The metal wood golf club head of claim 10, wherein said second density is greater than about 9.0 g/cc.

12. The metal wood golf club head of claim 11, wherein said second density is greater than about 10.0 g/cc.

13. The metal wood golf club head of claim 12, wherein said second material is tungsten.

14. The metal wood golf club head of claim 1, wherein a placement of said weight is constrained by an inner concentric circle and an outer concentric circle viewed from a two dimensional projection taken from a heel view of said golf club head;

said inner concentric circle has a radius of 89.4 mm with a center located 33.1 mm backwards along the z axis and 19.3 mm upward along the y-axis from a center of gravity of said golf club head;

said outer concentric circle has a radius of 94.8 mm with a center located 33.1 mm backward along the z axis and 19.3 mm upward along the y-axis from said center of gravity of said golf club head.

15. A metal wood golf club head comprising:

a body portion forming a natural contour of said golf club head;

a sole portion near a bottom of said golf club head; and a weight placed outside said natural contour of said golf club head;

wherein wherein said natural contour is defined by an inner concentric circle and an outer concentric circle viewed from a two dimensional projection taken from a heel view of said golf club head;

said inner concentric circle has a radius of 89.4 mm with a center located 33.1 mm backwards along the z axis and 19.3 mm upward along the y-axis from a center of gravity of said golf club head;

said outer concentric circle has a radius of 94.8 mm with a center located 33.1 mm backward along the z axis and 19.3 mm upward along the y-axis from said center of gravity of said golf club head; and wherein said weight is invisible from a top view from an address position.

16. The metal wood golf club head of claim 15, wherein said golf club head has a mass of less than about 195 grams.

17. The metal wood golf club head of claim 16, wherein said golf club head has a MOIy to Front to Back Distance Ratio of greater than about 838 g-cm;

said MOIy to Front to Back Distance Ratio defined is the MOIy of said golf club head divided by a front to back distance of said golf club head.

18. The metal wood golf club head of claim 15, wherein a first material used to form said body portion has a first density of between about 4.0 g/cc and about 5.0 g/cc and a second material used to form said weight has a second density that is greater than about 9.0 g/cc.

19. The metal wood golf club head of claim 18, wherein said first material is titanium.

20. The metal wood golf club head of claim 19, wherein said second material is tungsten.

* * * * *